US011414629B2

(12) United States Patent
Letzelter et al.

(10) Patent No.: US 11,414,629 B2
(45) Date of Patent: Aug. 16, 2022

(54) AUTOMATIC DISHWASHING METHOD

(71) Applicant: The Procter & Gamble Company, Cincinnati, OH (US)

(72) Inventors: Nathalie Sophie Letzelter, Trimdon (GB); Shari Joy Soper, Mason, OH (US); Sylvan Amos, Kalamazoo, MI (US); Kristopher L. Delgado, Stevensville, MI (US); Elliott Stowe, Stevensville, MI (US); Sarah Galea, St. Joseph, MI (US)

(73) Assignee: The Procter & Gamble Company, Cincinnati, OH (US)

( * ) Notice: Subject to any disclaimer, the term of this patent is extended or adjusted under 35 U.S.C. 154(b) by 87 days.

(21) Appl. No.: 16/876,150

(22) Filed: May 18, 2020

(65) Prior Publication Data

US 2020/0369989 A1 Nov. 26, 2020

(30) Foreign Application Priority Data

May 22, 2019 (EP) ..... 19176044

(51) Int. Cl.

| | |
|---|---|
| ***C11D 1/00*** | (2006.01) |
| ***C11D 3/386*** | (2006.01) |
| ***C11D 3/395*** | (2006.01) |
| ***C11D 3/04*** | (2006.01) |
| ***C11D 3/10*** | (2006.01) |
| ***C11D 3/20*** | (2006.01) |
| ***C11D 3/33*** | (2006.01) |
| ***C11D 3/39*** | (2006.01) |
| ***C11D 11/00*** | (2006.01) |
| ***B08B 3/08*** | (2006.01) |

(52) U.S. Cl.

CPC ..... *C11D 3/3956* (2013.01); *B08B 3/08* (2013.01); *C11D 3/044* (2013.01); *C11D 3/10* (2013.01); *C11D 3/2086* (2013.01); *C11D 3/33* (2013.01); *C11D 3/38609* (2013.01); *C11D 3/38618* (2013.01); *C11D 3/3902* (2013.01); *C11D 3/3905* (2013.01); *C11D 3/3942* (2013.01); *C11D 3/3947* (2013.01); *C11D 3/3951* (2013.01); *C11D 11/0023* (2013.01); *C11D 11/0064* (2013.01)

(58) Field of Classification Search

CPC ..... C11D 1/00; C11D 3/044; C11D 3/38618; C11D 3/38609; C11D 3/3902; C11D 3/3905; C11D 3/3942; C11D 3/33; B08B 3/08

USPC ..... 510/221, 224, 225, 372, 375, 376, 393, 510/477, 488, 499; 134/25.2

See application file for complete search history.

(56) References Cited

U.S. PATENT DOCUMENTS

| | | | | |
|---|---|---|---|---|
| 8,920,576 | B2 * | 12/2014 | Gentschev | C11D 7/3209 134/25.2 |
| 9,506,020 | B2 * | 11/2016 | Giles | C11D 3/33 |
| 2017/0215689 | A1 | 8/2017 | Rigobert | |
| 2019/0313879 | A1 | 10/2019 | Al-bayati | |

FOREIGN PATENT DOCUMENTS

| | | | |
|---|---|---|---|
| WO | WO9615710 | A1 | 5/1996 |

OTHER PUBLICATIONS

Extended European Search Report; Application No. 19176044.6-1105; dated Nov. 13, 2019; 6 pages.

PCT Search Report and Written Opinion for PCT/US2020/070044 dated Jul. 31, 2020.

* cited by examiner

*Primary Examiner* — Gregory R Delcotto

(74) *Attorney, Agent, or Firm* — Carolyn S. Powell; George H. Leal

(57) ABSTRACT

A method of washing dishware in a dishwasher comprising the step of delivering into the dishwasher: a) a first composition comprising oxygen bleach and substantially free of enzymes; followed by b) a second composition comprising enzymes wherein the first composition has a pH of at least 11 and the pH of the first composition is at least 1 pH unit greater the pH of the second composition wherein the pH is measured at wash concentration at 20° C.

10 Claims, No Drawings

Specification includes a Sequence Listing.

AUTOMATIC DISHWASHING METHOD

TECHNICAL FIELD

The present invention is in the field of automatic dishwashing. In particular, it relates to an automatic dishwashing method. The method provides good cleaning and presents a good environmental profile.

BACKGROUND OF THE INVENTION

The automatic dishwashing detergent formulator is continuously looking for ways to improve the performance of automatic dishwashing, in terms of cleaning, finishing and also reducing the amount of water and energy consumed during the process.

EP 3 171 748 A1 relates to a method of automatic dishwashing of dishware using wash water, wherein:

in a first step, a first composition, which comprises an oxygen bleach but substantially no enzyme, is supplied to the wash water, and the dishware is washed in a washing zone with the oxygen bleach-containing wash water; and in a second step which occurs after the first step, a second composition, which comprises an enzyme but substantially no bleach, is supplied to the wash water, and the dishware is washed in said washing zone with the enzyme-containing wash water.

The object of the present invention is to provide an automatic dishwashing method that provides improved cleaning and in particular, baked and burnt-on items and a more efficient use of water and energy than conventional dishwashing methods.

SUMMARY OF THE INVENTION

According to a first aspect of the invention, there is provided a method of washing dishware in a dishwasher. The method comprises the step of delivering two different compositions into the dishwasher. The first composition comprises bleach and it is substantially free of enzymes. The second composition comprises enzymes and it is preferably substantially free of bleach. The pH of the first composition is at least 11 and it is at least 1 pH unit higher than the pH of the second composition. The pH is measured in tap water at the wash concentration at 20° C.

The method provides very good cleaning across most of the soils found on dishware and allows for shorter washing times.

Preferably, the method comprises the delivery of an intermediate composition between the first and second composition. The intermediate composition helps to lower the pH without draining the water. It allows the first and the second composition to use the same water, thereby saving water and energy. The intermediate composition comprises a pH buffering composition. Preferably the pH buffering composition also has calcium binding properties. Improved cleaning results are obtained when the pH buffering composition has calcium binding properties.

An automatic dishwashing operation typically comprises three or more phases: a pre-wash cycle, a main-wash cycle and one or more rinse cycles, these phases are usually followed by a drying step. The first and second compositions of the present invention are preferably delivered into the main wash without the need for a pre-wash. The method of the invention does not require the drainage of the wash liquor before the second composition is delivered. Both compositions can use the same wash water.

According to a second aspect of the invention, there is provided an automatic dishwashing product. The product comprises three independent compositions: first, intermediate and second composition. The first composition is to be added first, followed by the intermediate composition and then the second composition. The first composition comprises oxygen bleach and is substantially free of enzymes and is capable of providing a wash pH of at least 11. The intermediate composition is capable of lowering the pH of the first composition by at least 1 pH unit. The second composition comprises enzymes.

According to a third aspect of the invention, there is provided the use of the method of the invention to reduce the duration of an automatic dishwashing process. This is especially relevant to the cleaning of burnt items which usually require the use of an intensive wash cycle.

According to a fourth aspect of the invention, there is provided a dishwasher that includes a main wash cycle and at least one rinse cycle, preferably at least two rinse cycles. The main wash cycle includes at least one introduction of chemistry compositions that includes a first composition that includes oxygen bleach and is substantially free of enzymes. The second composition includes enzymes. The first composition has a pH of at least 11 and the pH of the first composition is at least 1 pH unit greater the pH of the second composition, and the pH is measured at wash concentration at 20° C. The main wash cycle includes a first phase, a second phase, and optionally a third phase. The first phase includes delivery of the first composition and the time of exposure to the dishware of the first composition is preferably between 25 and at least 40 minutes. The second phase includes delivery of the second composition and the time of exposure to the dishware of the second composition is preferably at least 5 minutes. The optional third phase includes delivery of the third composition and the time of exposure to the dishware of the third composition is preferably at least 11 minutes. Temperature within the dishwasher during the main wash cycle is between about 45° C. to 65° C., with a preferred temperature of 65° C. This fourth aspect can also include at least one rinse cycle, during which the temperature within the dishwasher during at least one rinse cycle is between about 55° C. to about 65° C.

The elements of the method of the invention described in connexion with the first aspect of the invention apply mutatis mutandis to the second, third, and fourth aspects of the invention.

DETAILED DESCRIPTION OF THE INVENTION

The present invention encompasses a method of washing dishware in a dishwasher and the use of the method to reduce the length of an automatic dishwashing process and a dishwasher. The method provides superior cleaning, potentially utilising less energy and/or water and/or chemicals. "Dishware" herein means all items related to cooking and eating that are usually washed in a dishwasher.

The composition of the method and product of the invention are referred herein as "the composition of the invention".

As used herein, the articles including "a" and "an" are understood to mean one or more of what is claimed or described. Unless otherwise noted, all component or composition levels are in reference to the active portion of that component or composition, and are exclusive of impurities, for example, residual solvents or by-products, which may be present in commercially available sources of such components or compositions. Unless specifically stated or the context otherwise requires, embodiments described herein apply equally to all aspects of the invention. Percentages quoted are by weight, unless otherwise stated or the context otherwise requires.

The Method of the Invention

The invention provides a method of washing soiled dishware in a dishwasher. The method comprises the step of firstly delivering a first composition followed by a second composition. The first composition has time to act before the second composition is added.

The first composition comprises oxygen bleach but substantially no enzyme, and the second composition comprises enzyme. Preferably, the second composition is substantially free of bleach (whether oxygen bleach, halogen bleach or any other type of bleach). Preferably, the first composition contains no more than 0.1 wt % enzymes, preferably no more than 0.01 wt % enzymes, preferably no more than 0.001 wt % enzymes, preferably no more than 0.0001 wt % enzymes, preferably no more than trace amounts of enzymes, preferably no enzymes. Preferably, the second composition contains no more than 2 wt % bleach, preferably no more than 1 wt % bleach, preferably no more than 0.5 wt % bleach, preferably no more than 0.1 wt % bleach, preferably no more than trace amounts of bleach, preferably no bleach.

The delivery of the second composition is preferably at least 5 minutes, more preferably at least 10 minutes and especially 15 minutes after the delivery of the first composition. The second composition is preferably delivered after approximately one third of the duration of the cycle and before two thirds of the duration of the cycle. The delivery time of the first and second compositions can be optimised depending on the type of soils that the dishware has, for example if the dishware load contains enzymatic soils then it might be preferred to give the second composition more acting time than the first composition. But if the load contains baked or burnt soils, it might be preferred to increase the proportion of time spent with the first chemistry. Preferably, the first and the second composition are delivered into the main wash cycle. If for example, the duration of the main wash is 40 mins, the first composition can be added when the cycle starts and let it act from approximately 20 minutes and then optionally adding the intermediate composition and let it act for approximately 4 minutes and then 24 minutes after the first composition is added, the second composition is added.

The pH of the first composition is at least 11, preferably at least greater than 11, more preferably at least about 11.5 and especially about 12. The pH of the second composition is at least 1 pH unit, more preferably at least 1.2 and especially at least 1.3 units lower than the pH of the first composition. Especially preferred is when the first composition has a pH greater than 11 and the second composition has a pH 1.2 units less. The pH is measured at the wash concentration in tap water and at 20° C. The method optionally but preferably comprises the step of delivering an intermediate composition after the first composition and before the second composition. The intermediate composition allows the pH of the wash liquor to decrease at least 1 unit, preferably at least 1.2 units, more preferably at least 1.3 units.

Although in the method of the invention it is possible to use an oxygen bleach scavenger in the intermediate or in the second composition, this is not essential. The wash water does not need to be removed from the interior of the dishwasher and fresh wash water does not need to be used in the second step, thereby saving water.

In one embodiment, the main wash cycle can be thought of as 3 phases which correspond to the dosing of the compositions. In a first phase of the main wash cycle, the first composition is delivered and dosed at the beginning of the main wash cycle after filling the dishwasher with water. As time is among the important factors for removing soils such as baked-on soils, the time with this first composition is preferably at least 40 minutes. This time can be shortened for quick cycles, but minimum time of 25 minutes is preferred be used even for short cycles. Also, the temperature for this first phase is important as well. Higher temperatures are associated with better baked-on cleaning. A target of 65° C. is most preferred, with 55° C. as a trade-off for a quicker cycle or to reduce energy with 45° C. as the least temperature to achieve cleaning performance.

In a second phase of the main wash cycle, the second phase begins with the addition of a buffering chemistry, which can include the second composition to reduce the pH of the main wash liquid according to the needs of the third composition which will be added in the third phase of the main wash cycle. Typically, there is no heat added during this phase. Time spent in this phase should be preferably about 5 minutes following the dosing of the second composition to allow the dishwasher to cycle through all the wash zones within the dishwasher and for the dilution of all the wash liquid inside the dishwasher.

In a third phase of the main wash, the third phase begins with the addition of the enzymes corresponding to the third composition of the chemistry. While non-burnt-on foods respond to longer cleaning times in this phase, a shorter time is desirable as a trade-off for energy consumption and overall cleaning performance. This third phase has a preferred time of about 11 minutes, although longer times in this phase would benefit cleaning performance if energy and time are not considered as important. The temperature in this third phase is a byproduct of the temperature desired for the first phase. For example, if the temperature of the first phase is most significant, it is possible to either (1) maintain temperature through this third phase, (2) allow the temperature to decrease towards ambient temperature, or to (3) continue towards the desired temperature (if it was not achieved in the first phase) since temperature in this phase in this example is not considered a factor for cleaning.

Further in this embodiment, following the main wash cycle, there is a complete drain of the dishwasher tub and refill for an intermediate rinse cycle. The purpose of this intermediate rinse cycle is to remove bulk soils from the wash bath, neutralize pH, and remove chemistry that could cause spotting and filming on dishes if not diluted. The time and temperature of this intermediate rinse cycle are not critical. Typically, there is no heat added during this phase. Time spent in this phase should be ideally at least about 5 minutes to allow the machine to cycle through all the zones.

The last cycle segment in this embodiment is the final rinse cycle. This cycle begins with a fill of the dishwasher tub following the drain of the dishwasher tub at the end of the intermediate rinse cycle. The temperature of the liquid in the tub of this final rinse cycle is a significant factor for cleaning of soils such as standard cheese soil, although other soils tested did not respond to higher temperature or longer time in the final rinse cycle. So, the final rinse temperature is most desired to be 55° C. for overall cleaning performance, but a range of about 55° C. to about 65° C. will allow for cleaning performance. The time for the final rinse cycle is preferably at least about 10 minutes. This time optimizes energy performance and allows dilution and rinsing of the dishware in each rack of the dishwasher. In testing, longer times in this final rinse cycle did not result in significantly better cleaning performance During this final rinse phase, standard rinse aid can be optionally dispensed to improve drying.

It is understood that the dosing of the compositions described herein can include dosing by several methods such as unit dosing of a tablet, powder or liquid or bulk dosing a portion of the compositions from a certain volume stored in the dishwasher. In the case of a unit-dose chemistry, the dishwasher user would refill the composition dispenser before each cycle with an amount of each composition for one cycle. For bulk dosing, the dishwasher user would need to refill a container inside the dishwasher for each composition at some frequency where the stored composition can be dosed over at least one cycle.

The first composition comprises an oxygen bleach, preferably percarbonate. It may further comprise an alkalinity source, preferably a hydroxide, more preferably sodium hydroxide. It may further comprise complexing agent, polymer, bleach catalyst, bleach activator, surfactant and mixtures thereof. Preferably, the first composition comprises oxygen bleach, alkalinity source, complexing agent, dispersant polymer, bleach catalyst and/or bleach activator and surfactant. The weight of the first composition delivered to the dishwasher is preferably from about 5 to 25 grams, more preferably from 8 to 20 grams.

The Intermediate Composition

The role of the intermediate composition is to reduce the pH of the wash liquor comprising the first composition before the second composition is added. The intermediate composition comprises a pH buffering system. Preferably the buffering system comprises an organic acid, more preferably a carboxylic acid and more preferably the buffer is selected from a polycarboxylic acid, its salt and mixtures thereof. Preferably the intermediate composition has also calcium binding properties. Preferably the pH buffering system comprises citric acid and more preferably citric acid and bicarbonate. More preferably, the intermediate composition comprises from 2 to 15, more preferably from 2 to 12 grams of citric acid and optionally sodium bicarbonate. If sodium bicarbonate is present in the second composition, it is preferably present in an amount of from 0.5 to 4, more preferably from 1 to 3 grams.

The Second Composition

The second composition comprises enzymes, preferably selected from the group consisting of amylases, proteases, lipases, cellulases, beta-glucanases and mixtures thereof, preferably amylases and proteases. The level of active enzymes delivered into the wash is from about 10 to 200 mg, more preferably from about 5 to 100 mg, more preferably from about 20 to 80 mg of protease and from about 1 to about 50 mg, more preferably from about 5 to about 40 mg of amylase per wash.

The Product of the Invention

The product comprises three independent compositions: first, intermediate and second composition. The first composition is to be added first, followed by the intermediate composition and then the second composition. The first composition comprises oxygen bleach, preferably sodium percarbonate, and is substantially free of enzymes and is capable of providing a wash pH of at least 11. The intermediate composition is capable of lowering the pH of the first composition by at least 1 pH unit, preferably at least 1.2 pH units and more preferably at least 1.3 units. The second composition comprises enzymes.

The first composition should be designed with an excess pH, i.e, a pH well above 11 so it can provides a pH of at least 11 at the wash concentration.

The product of the invention can be provided in a single reservoir either external or as part of the dishwasher wherein the three compositions are separated and adapted to be delivered separately. Alternatively, the three compositions can be stored in different reservoirs.

Compositions

The compositions of the invention can be in any physical form. It can be a loose powder, a liquid or gel or presented in unit dose form, unit dose forms include pressed tablets and water-soluble packs. The compositions can be added from the dispenser of the dishwasher at different times or the dishwasher can have a dosing system adapted to take a plurality of doses that can be delivering in a plurality of dishwashing processes.

The compositions are preferably phosphate free. By "phosphate-free" is herein understood that a composition comprises less than 1%, preferably less than 0.1% by weight of the composition of phosphate.

Alkalinity Source

The alkalinity source is preferably selected from the group consisting of carbonate, hydroxide, silicate and mixtures thereof. Preferably the alkalinity source comprises sodium hydroxide. The amount of alkalinity source present in the first composition of the invention is such that the pH at the wash liquor composition and 20° C. is at least 11 pH units.

Complexing Agent

For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 3. The stability constant, log K, is measured in a solution of ionic strength of 0.1, at a temperature of 25° C.

Any composition of the invention can comprise a complexing agent. Preferably the first composition of the invention comprises from 10% to 50% by weight of the composition of a complexing agent. Preferably, the composition comprises a complexing agent selected from the group consisting of citric acid, methyl glycine diacetic acid (MGDA), glutamic-N,N-diacetic acid (GLDA), iminodisuccinic acid (IDS), carboxy methyl inulin, L-Aspartic acid N,N-diacetic acid tetrasodium salt (ASDA) and mixtures thereof. For the purpose of this invention, the term "acid", when referring to complexing agents, includes the acid and salts thereof.

In a preferred embodiment, the first composition comprises from 15% to 40% by weight of the composition of MGDA, more preferably the tri-sodium salt of MGDA. Compositions comprising this high level of MGDA perform well in the presence of hard water and also in long and/or hot cycles. Preferably the first composition comprises from 3 to 12 grams of MGDA, more preferably from 4 to 10.

Dispersant Polymer

A dispersant polymer can be used in any suitable amount from about 0.1 to about 20%, preferably from 0.2 to about 15%, more preferably from 0.3 to % by weight of any of the compositions. It is preferably present in the first composition.

The dispersant polymer is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Mettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionised water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water.

The preferred dispersant polymers are sulfonated/carboxylated polymers, i.e., polymer comprising both sulfonated and carboxylated monomers.

Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

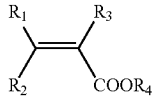

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

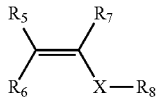

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide.

and at least one structural unit derived from at least one sulfonic acid monomer having the general formula (V) and (VI):

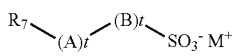

(V)

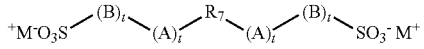

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercially available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers.

Alternatively, the dispersant polymer can be selected from the group consisting of alkoxylated polyalkyleneimines, alkoxylated polycarboxylates, polyethylene glycols, styrene copolymers, cellulose sulfate esters, carboxylated polysaccharides, amphiphilic graft copolymers and mixtures thereof. Preferably the first composition comprises from 0.1 to 3, more preferably from 0.2 to 2 grams of dispersant polymer, more preferably sulfonate carboxylate polymer.

Bleaching System

The first composition of the invention comprises oxygen bleach, preferably percarbonate in combination with a bleach activator or a bleach catalyst or both. Preferably the bleach activator is TAED and the bleach catalyst is a manganese bleach catalyst.

Bleach

The first composition of the invention preferably comprises from about 10 to about 20%, more preferably from about 12 to about 18% of bleach, preferably percarbonate, by weight of the composition.

Alkali metal percarbonates, particularly sodium percarbonate is the preferred bleach for use herein. The percarbonate is most preferably incorporated into the products in a coated form which provides in-product stability. The first composition of the invention can comprise other bleaches in addition to percarbonate. Inorganic and organic bleaches that can be used in addition to percarbonate include perhydrate salts such as perborate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Potassium peroxymonopersulfate is another inorganic perhydrate salt of utility herein. Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid). Preferably the first composition comprises from 0.5 to 4, more preferably from 1 to 2 grams of percarbonate.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the first composition of the method of the invention comprises from 0.01 to 5, preferably from 0.2 to 2% by weight of the composition of bleach activator, preferably TAED.

Bleach Catalyst

The first composition herein preferably comprises a bleach catalyst, preferably a metal containing bleach catalyst. More preferably the metal containing bleach catalyst is a transition metal containing bleach catalyst, especially a manganese or cobalt-containing bleach catalyst. Bleach catalysts preferred for use herein include manganese triazacyclononane and related complexes; Co, Cu, Mn and Fe bispyridylamine and related complexes; and pentamine acetate cobalt(III) and related complexes. Especially preferred bleach catalyst for use herein are 1,4,7-trimethyl-1,4,7-triazacyclononane (Me-TACN) and 1,2,4,7-tetramethyl-1,4,7-triazacyclononane (Me/Me-TACN).

Preferably the first composition of the method of the invention comprises from 0.001 to 0.5, more preferably from 0.002 to 0.05%, more preferably from 0.005 to 0.075% of bleach catalyst by weight of the composition. Preferably the bleach catalyst is a manganese bleach catalyst. Preferably the first composition comprises from 1 to 20, more preferably from 1 to 10 mg of manganese bleach catalyst.

Inorganic Builder

The compositions of the invention preferably comprises an inorganic builder, more preferably, the first composition comprises an inorganic builder. Suitable inorganic builders are selected from the group consisting of carbonate, silicate and mixtures thereof. Especially preferred for use herein is sodium carbonate. Preferably the first composition of the method of the invention comprises from 5 to 60%, more preferably from 10 to 50% and especially from 15 to 45% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the first composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation. Preferably the first composition comprises from 0.2 to 4, more preferably from 0.5 to 2 grams of surfactant, preferably non-ionic surfactant.

Enzymes

The second composition of the invention comprises enzymes. The enzymes are preferably selected from amylase, proteases, lipases, cellulases, beta-glucanases and mixtures thereof. Preferably the second composition comprises amylase and protease.

Protease

The second composition of the invention may comprise a protease or a mixture of proteases. A mixture of two or more proteases can contribute to an enhanced cleaning across a broader temperature, cycle duration, and/or substrate range, and provide superior shine benefits, especially when used in conjunction with the first composition.

Suitable proteases for use in the second composition include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), especially those derived from *Bacillus*, such as *Bacillus* sp., *B. lentus, B. alkalophilus, B. subtilis, B. amyloliquefaciens, B. pumilus, B. gibsonii*, and *B. akibaii* described in WO2004067737, WO2015091989, WO2015091990, WO2015024739, WO2015143360, U.S. Pat. Nos. 6,312,936 B1, 5,679,630, 4,760,025, DE102006022216A1, DE102006022224A1, WO2015089447, WO2015089441, WO2016066756, WO2016066757, WO2016069557, WO2016069563, WO2016069569 and WO2016174234. Specifically, mutations S9R, A15T, V66A, A188P, V199I, Q239R, N255D (savinase numbering system)

(b) trypsin-type or chymotrypsin-type proteases, such as trypsin (e.g., of porcine or bovine origin), including the Fusarium protease described in WO 89/06270 and the chymotrypsin proteases derived from Cellumonas described in WO 05/052161 and WO 05/052146.

(c) metalloproteases, especially those derived from *Bacillus amyloliquefaciens* described in WO07/044993A2; from *Bacillus, Brevibacillus, Thermoactinomyces, Geobacillus, Paenibacillus, Lysinibacillus* or *Streptomyces* spp. Described in WO2014194032, WO2014194054 and WO2014194117; from *Kribella alluminosa* described in WO2015193488; and from *Streptomyces* and *Lysobacter* described in WO2016075078.

(d) protease having at least 90% identity to the subtilase from *Bacillus* sp. TY145, NCIMB 40339, described in WO92/17577 (Novozymes A/S), including the variants of this *Bacillus* sp TY145 subtilase described in WO2015024739, and WO2016066757.

Preferred proteases for the second composition of the method of the invention are polypeptides demonstrating at least 90%, preferably at least 95%, more preferably at least 98%, even more preferably at least 99% and especially 100% identity with the wild-type enzyme from *Bacillus* lentus, comprising mutations at one or more, preferably two or more and more preferably three or more of the following positions, using the BPN' numbering system: 9, 15, 68, 76, 78, 87, 99, X101, 103, 104, 118, 118, 128, 129, 130, 167, 170, 194, 205, 206, 209, 222, 245. Most preferably the protease comprises one or more, preferably two or more and more preferably three or more of the following mutations using the BPN' numbering system and amino acid abbreviations as illustrated in WO00/37627 which is incorporated herein by reference: S9R, A15T, V68A, N76D, N87S, S99D, S99E, S99SD, S99A, S101G, S101M, S103A, V104N/I, G118V, G118R, S128L, P129Q, S130A, Y167A, R170S, A194P, V205I, Q206L/D/E, Y209W, M222S, and/or Q245R.

Preferably the protease is selected from the group of proteases comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N (vii) S99AD (viii) S99E (ix) S9R+A15T+V68A+N218D+Q245R Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase®, Coronase®, Blaze®, Blaze Ultra® and Esperase® by Novozymes A/S (Denmark); those sold under the tradename Maxatase®, Maxacal®, Maxapem®, Properase®, Purafect®, Purafect Prime®, Purafect Ox®, FN3®, FN4®, Excellase®, Ultimase® and Purafect OXP® by Dupont; those sold under the tradename Opticlean® and Optimase® by Solvay Enzymes; and those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D); and KAP (*Bacillus* alkalophilus subtilisin with mutations A230V+S256G+S259N) from Kao.

Especially preferred for use herein is a combination of two or more proteases selected from the group consisting of Properase®, Blaze®, Ultimase®, Everlase®, Savinase®, Excellase®, Blaze Ultra®, BLAP and BLAP variants.

Preferably, the second composition comprises from 5 to 100, more preferably from 10 to 60 mg of active protease.

Amylases

Preferably the composition of the invention may comprise an amylase. Suitable alpha-amylases include those of bacterial or fungal origin. Chemically or genetically modified mutants (variants) are included. A preferred alkaline alpha-amylase is derived from a strain of *Bacillus*, such as *Bacillus* licheniformis, *Bacillus* amyloliquefaciens, *Bacillus* stearothermophilus, *Bacillus* subtilis, or other *Bacillus* sp., such as *Bacillus* sp. NCBI 12289, NCBI 12512, NCBI 12513, DSM 9375 (USP 7,153,818) DSM 12368, DSMZ no. 12649, KSM AP1378 (WO 97/00324), KSM K36 or KSM K38 (EP 1,022,334). Preferred amylases include:

(a) variants described in USP 5,856,164 and WO99/23211, WO 96/23873, WO00/60060, WO06/002643 and WO2017/192657, especially the variants with one or more substitutions in the following positions versus versus the AA560 enzyme listed as SEQ ID No. 12 in WO 06/002643:

26, 30, 33, 82, 37, 106, 118, 128, 133, 149, 150, 160, 178, 182, 186, 193, 202, 214, 231, 246, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(b) variants exhibiting at least 85%, preferably 90% identity with SEQ ID No. 4 in WO06/002643, the wild-type enzyme from *Bacillus* SP722, especially variants with deletions in the 183 and 184 positions and variants described in WO 00/60060, WO2011/100410 and WO2013/003659, particularly those with one or more substitutions at the following positions versus SEQ ID No. 4 in WO06/002643 which are incorporated herein by reference: 51, 52, 54, 109, 304, 140, 189, 134, 195, 206, 243, 260, 262, 284, 347, 439, 469, 476 and 477.

(c) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one or more of M202L, M202V, M202S, M202T, M202I, M202Q, M202W, S255N and/or R172Q. Particularly preferred are those comprising the M202L or M202T mutations.

(d) variants described in WO 09/149130, preferably those exhibiting at least 90% identity with SEQ ID NO: 1 or SEQ ID NO:2 in WO 09/149130, the wild-type enzyme from *Geobacillus* Stearophermophilus or a truncated version thereof.

(e) variants described in WO10/115021, especially those exhibiting at least 75%, or at least 85% or at least 90% or at least 95% with SEQ ID NO:2 in WO10/115021, the alpha-amylase derived from *Bacillus* sp. TS-23.

(f) variants exhibiting at least 89% identity with SEQ ID NO:1 in WO2016091688, especially those comprising deletions at positions H183+G184 and additionally one or more mutations at positions 405, 421, 422 and/or 428.

(g) variants described in WO2014099523, especially those exhibiting at least 60% amino acid sequence identity with the "PcuAmy1 α-amylase" from *Paenibacillus curdlanolyticus* YK9 (SEQ ID NO:3 in WO2014099523).

(h) variants described in WO2014099523, especially those exhibiting at least 60% amino acid sequence identity with the "CspAmy2 amylase" from *Cytophaga* sp. (SEQ ID NO:6 in WO2014164777).

(i) variants exhibiting at least 85% identity with AmyE from *Bacillus* subtilis (SEQ ID NO:1 in WO2009149271).

(j) variants exhibiting at least 90% identity with the wild-type amylase from *Bacillus* sp. KSM-K38 with accession number AB051102.

(k) variants described in WO2016180748, especially those exhibiting at least 80% identity with the mature amino acid sequence of AAI10 from *Bacillus* sp in SEQ ID NO: 7 in WO2016180748; those exhibiting at least 80% identity with the mature amino acid sequence of *Alicyclobacillus* sp. amylase in SEQ ID NO: 8 in WO2016180748, and those exhibiting at least 80% identity with the mature amino acid sequence of SEQ ID NO: 13 in WO2016180748, especially those comprising one or more of the following mutations H*, N54S, V56T, K72R, G109A, F113Q, R116Q, W167F, Q172G, A174S, G184T, N195F, V206L, K391A, P473R, G476K.

(l) variants described in WO2018060216, especially those exhibiting at least 70% identity with the mature amino acid sequence of SEQ ID NO: 4 in WO2018060216, the fusion molecule of *Bacillus amyloliquefaciens* and *Bacillus licheniformis*. Especially those comprising one or more substitutions at positions H1, N54, V56, K72, G109, F113, R116, T134, W140, W159, W167, Q169, Q172, L173, A174, R181, G182, D183, G184, W189, E194, N195, V206, G255, N260, F262, A265, W284, F289, S304, G305, W347, K391, Q395, W439, W469, R444, F473, G476, and G477.

Preferably the amylase is an engineered enzyme, wherein one or more of the amino acids prone to bleach oxidation have been substituted by an amino acid less prone to oxidation. In particular it is preferred that methionine residues are substituted with any other amino acid. In particular it is preferred that the methionine most prone to oxidation is substituted. Preferably the methionine in a position equivalent to 202 in SEQ ID NO:11 is substituted. Preferably, the methionine at this position is substituted with threonine or leucine, preferably leucine.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL®, ATLANTIC®, ACHIEVE ALPHA®, AMPLIFY® PRIME, INTENSA® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE®, PREFERENZ S® series (including PREFERENZ S1000® and PREFERENZ S2000® and PURASTAR OXAM® (DuPont, Palo Alto, Calif.) and KAM® (Kao, 14-10 Nihonbashi Kayabacho, 1-chome, Chuo-ku Tokyo 103-8210, Japan). In one aspect, suitable amylases include ATLANTIC®, STAINZYME®, POWERASE®, INTENSA® and STAINZYME PLUS® and mixtures thereof.

Preferably, the second composition comprises at least 0.01 mg, preferably from about 1 to about 50, more preferably from about 5 to about 40, mg of active amylase.

Preferably, the enzymes of the second composition of the method of the invention are in the form of granulates, the granulates comprise more than 29% of sodium sulfate by weight of the granulate and/or the sodium sulfate and the active enzyme (protease and/or amylase) are in a weight ratio of between 3:1 and 100:1 or preferably between 4:1 and 30:1 or more preferably between 5:1 and 20:1.

B-glucanases

The second composition may comprise polypeptides of glycoside hydrolase family 16 (GH 16) having beta-glucanase activity (e.g. comprising or consisting of licheninase EC 3.2.1.73, β-1,3-1,4-endoglucanase EC 3.2.1.6 and/or β-1,3-endoglucanases; β-1,3-endoglucanase EC 3.2.1.39 activity) which are highly active in degrading different types of beta-glucans (e.g. beta-D-glucans, beta-1,3-1,4 glucans, mix-linkage beta-glucans, barley beta-glucans and oatmeal beta-glucans). Preferred B-glucanases include:

(a) Variants exhibiting at least 88% identity with *Bacillus agaradhaerens* beta-glucanase described in SEQ ID NO:1 or fragments of thereof.

(b) Variants exhibiting at least 80% identity with *Bacillus* sp. beta-glucanase described in SEQ ID NO:2 or fragments of thereof.

(c) Variants exhibiting at least 89% identity with *Bacillus akibai* beta-glucanase described in SEQ ID NO:3 or fragments of thereof.

(d) Variants exhibiting at least 89% identity with *Bacillus mojavensis* beta-glucanase described in SEQ ID NO:4 or fragments of thereof.

(e) Variants exhibiting at least 89% identity with *Bacillus amyloliquefaciens* beta-glucanase described in SEQ ID NO: 5

(f) Variants exhibiting at least 89% identity with *Bacillus subtilis* beta-glucanase described in SEQ ID NO: 6

B-glucanase sequences:

| Sequence | Organism | Sequence |
|---|---|---|
| SEQ 1 | *Bacillus agaradhaerens* (237aa) | MLTLLMMSFAGAAYAHNPVTDEEVYHSFNSHDW QNWNMSDGWKNDDYFFGCHWSQNRVNFYGGQ MELSLRTNYSYAPPYNYECAEYTTNNFYGYGLYE VSMKPAKVSGVISSFFTYTGPSYNGAPWDEIDIEFL GNDTTKVQFNYYTDGVGGNEILYDLGFDAADSYN TYAFDWQENYINWYVNGQLVATATENIPSNPSKI MMNIWNTYGIDEWAGRYYGEDANASYNWVRYT PNR |
| SEQ 2 | *Bacillus sp* (379aa) | MVKIKINNSIRIVMLTLIMMSVSVVAYAYNPVTED ELYHSFDSHDARNWQISDGWRNGDDFFGCHWSQ NRVNFNRGEMELSLRTNYSYSAPYNYECAEYATS NFYGYGLYEVSMKPANVSGVISSFFTYTGPSYNGA PWDEIDIEFLGNDTTKVQFNYYTNGVGGNEIIYDL GFDAANSFNTYAFDWQENYISWYVNGNLVATATE NIPSNPSKIMMNVWNTYGIDEWAGAYGGEAANAT YEWVRYTPNNGNTTPSTAPDFQLQACDYSDSSGIT SWSCGVGTFHSSNWIKFDSVDLSTGYNAFAVSYTS PGSGSFDIRLGSPHGQRIGTVNYGATGGWSNYEWS GTPSLDVTVRGAHDIYIVATSGAANLREFWFKNE |
| SEQ 3 | *Bacillus akibai* (276aa) | MKKKFVLFSMCLLLFSGLITGLVQSPQVAEAAERP IGTTFVETFESYDSERWSKAGVWTNGQMFNATWY PEQVTFSDGKMKLQIDKEDNETASPPYKAGELRTN DFYHYGLFEVSMKPAKSTGTVSSFFTYTGPWDWD NDPWDEIDIEFLGKDTTKIQFNYFTNGVGGNEHYH ELGFDAADDFNTYAFEWRPESIRWFVNGELVHTA TENIPQTPQKIMMNLWPGIGVDGWTGRFNGEDTP VVTQYDWVKYTPLEELGCYNEKNNKYKKCKKTK VK |
| SEQ 4 | *Bacillus mojavensis* (243aa) | MSYRMKRVLLLLVTGLFMSLSAFTSTASAQTGGSF FDPFNGYNSGFWQKANGYSNGNMFNCTWRANNV SMTSLGEMRLALTSPSYNKFDCGENRSVQTYGYG LYEVRMKPAKNVGIVSSFFTYTGPTDGTPWDEIDIE FLGKDTTKVQFNYYTNGVGNHEKLVDLGFDAAN AYHTYAFDWQPNSIKWYVDGQLKHTATSQIPTTP GKIMMNLWNGTGVDEWLGSYNGVTPLYAHYDW VRYTKK |
| SEQ 5 | *Bacillus amyloliquefaciens* (214aa) | QTGGSFFEPFNSYNSGLWQKANGYSNGDMFNCT WRANNVSMTSSGEMRLALTSPSYNKFDCGENRSV QTYGYGLYEVRMKPAKNTGIVSSFFTYTGPTDGTP WDEIDIEFLGKDTTKVQFNYYTNGAGNHEKVADL GFDATNAYHTYAFDWQPNSIKWYVDGQLKHTAT SQIPTNPGKIMMNLWNGIGVDDWLGSYNGVNPLY AHYDWVRYTKK |
| SEQ 6 | *Bacillus subtilis* (214aa) | QTGGSFFDPFNGYNSGFWQKADGYSNGNMFNCT WRANNVSMTSLGEMRLALTSPAYNKFDCGENRS VQTYGYGLYEVRMKPAKNTGIVSSFFTYTGPTDGT PWDEIDIEFLGKDTTKVQFNYYTNGAGNHEKIVDL GFDAANAYHTYAFDWQPNSIKWYVDGQLKHTAT NQIPTTPGKIMMNLWNGTGVDEWLGSYNGVNPLY AHYDWVRYTKK |

EXAMPLES

The cleaning provided by different methods is evaluated: Method A, outside the scope of the invention, delivers a single composition into the main wash. Method B, outside the scope of the invention, delivers the first composition (comprising bleach) and the second composition (comprising enzyme) having the same pH (10.5). Method C, according to the invention, delivers the first composition at pH 11.9, the intermediate composition, and the second composition at pH 10.5. Method D, according to the invention, delivers the first composition at pH 11.9, the intermediate composition, and the second composition at pH 7.5. Method E, outside the scope of the invention, delivers the first composition at pH 7.9, the intermediate composition, and the second composition at pH 11.9.

The method evaluates the removal of triple corn starch, baked cheese and double egg yolk on CFT tiles and the removal of baked-on macaroni cheese (Mac & Cheese) from copper saucepans.

The baked-on Mac & Cheese is representative of baked and burnt soiled items that do not get cleaned in a typical wash.

Soils used for Cleaning Test

CFT tiles (Center For Testmaterials BV. Stoomloggerweg 11, 3133 KT Vlaardingen, the Netherlands), which are stained melamine dishwasher monitors that discriminate the performance of the product to remove enzyme sensitive stains among others, were tested.

CFT DM 06 (baked cheese)—representative of baked-on items

CFT DM 376 (triple corn starch)—representative of starchy food soils

CFT DM 22: (double egg yolk)—representative of protein foods

All tiles were cut in half and two tiles per wash of each stain were placed in the upper rack of the dishwasher.

After subjecting the tiles to the dishwashing process the tiles were evaluated using a computer aided image analysis to assign a stain removal index, having a continuous scale from 0 to a 100, where 0% is unwashed and 100% is a complete removal of the stain.

Mac & Cheese Recipe

Revere 1 quart copper bottom saucepans with handle removed were used. The soiled substrates were prepared the day before the test was run and allowed to air dry overnight.

Kraft Macaroni & Cheese Dinner (7.25 oz. box) was used following the below recipe.

Heat 6 cups of water (8 gpg) into a 3-quart saucepan, add 165 gms of the macaroni from the Kraft Macaroni and Cheese Dinner when the water boils and stir. Boil for 7 minutes.

Microwave two sticks of Imperial 53% Vegetable Oil Spread for 1 minute 30 seconds.

Measure out 1 cup whole milk and pour it into the food processor, add the drained macaroni and pour the warm, melted Imperial Spread. Add the entire cheese packet, blend in food processor for 2 minutes.

Apply 10 grams of mac & cheese soil evenly on each saucepan using a brush. Finish soiling the pot by going around the sides with an upward stroke of the brush.

Allow pots to air dry at least 45 minutes before baking.

Pre-heat Vulcan convection oven to 400° F. (204° C.). When the oven reaches desired temperature, bake the saucepan for 7 minutes.

Two saucepans are placed in the dishwasher and are visually graded by 3 independent panelists: the higher the number the cleaner the saucepan.

Description of the Grading Scale?

Ballast Soil:

50 g of ballast soil is added per dishwasher. The composition is as follows:

| | | |
|---|---|---|
| Campbell's cream of mushroom soup | 18.75 | +/−0.2 g |
| Kellogg's cornflakes | 31.5 | +/−0.2 g |
| Kraft cheese slices | 13.5 | +/−0.2 g |
| Grated cheddar | 13.5 | +/−0.2 g |
| Smash | 40.5 | +/−0.5 g |
| Frozen corn | 27.0 | +/−0.2 g |
| Frozen spinach | 27.0 | +/−0.2 g |
| Cooked Napolina spaghetti | 21.0 | +/−0.2 g |
| Crumbed chicken goujons | 19.5 | +/−0.2 g |
| Beef fat | 70.5 | +/−0.5 g |
| DI water | 500 | +/−1.0 g |
| Total | 1100 g | |

1. Eggs should be mixed together before being weighed out.
2. Lettuce must be fresh, do not freeze
3. Just use the slices of the bread, do not use the crusts at the beginning and end of loaf.
4. Soups are added straight from the can, no additional water is required. Chicken Noodle soup should be chopped before being added to mixer.
5. Frozen items can be added slightly frozen. Defrost the spinach in the microwave or by setting aside to one side before preparing the soil.
6. Cook the spaghetti in water of medium hardness (~8 gpg) as per instructions. Then drain but DO NOT RINSE. Weigh out after cooking.
7. Beef fat must be melted completely and thoroughly mixed by stirring before weighing out.
8. Add the ingredients to the mixer in the order listed, with the beef fat being added last.
9. Add the water slowly and stop and scrape sides if required.

Test Details:

Dishwashers: KDTM354DSS

Inlet water temperature set at 120° F. with hardness of 8 gpg.

First composition

| Grams active | Method E | Method C and D | Method A and B |
|---|---|---|---|
| MGDA | 8 | 8 | 8 |
| 588 | 0.8 | 0.8 | 0.8 |
| PC | 2.83 | 2.83 | 2.83 |
| PAAN | 0.002 | 0.002 | 0.002 |
| Na OH | — | 6 | 0.5 |
| TO7 | 0.7 | 0.7 | 0.7 |
| SLF180 | 0.9 | 0.9 | 0.9 |
| Na bicarbonate | 2 | — | — |
| Citric acid anhydrous | 2 | — | — |

Intermediate composition

| Grams active | Method E | Method D | Method A and B | Method C |
|---|---|---|---|---|
| Na bicarbonate | | 2 | — | — |
| Citric acid anhydrous | | 11.5 | — | 8 |
| Na OH | 7 | | — | — |

Second composition

| Grams active | All test legs |
|---|---|
| Protease | 0.035 |
| Amylase | 0.009 |

Cleaning Results:

| | Method A | Method B | Method C | Method D | Method E |
|---|---|---|---|---|---|
| First composition | First composition + Second composition added at the start. | 25 min pH 10.5 — 4 min | 25 min pH 11.9 4 min pH 12 to 10.5 | 25 min pH 11.9 4 min pH 11.9 to 7.5 | 25 min pH 7.9 4 min pH 7.9 to 11.9 |
| Intermediate composition | | | | | |
| Second composition | 54 min Main wash | 25 min pH 10.5 | 25 min pH 10.5 | 25 min pH 7.5 | 25 min pH 11.9 |
| Triple Corn Starch | 82.4 | 81.2 | 85.9 | 87.0 | 75.9 |
| Baked Cheese | 84.5 | 66.1 | 91.6 | 97.8 | 36.9 |
| Double Egg Yolk | 36.5 | 33.2 | 73.6 | 95.6 | 45.3 |
| Mac & Cheese | 2.9 | 3.6 | 5.5 | 4.5 | 3.2 |

As it can be seen from the table above the best cleaning results are obtained when the first composition is delivered first at a pH of at least 11 and the second composition is delivered after the second composition at a lower pH (Methods C and D).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 6

<210> SEQ ID NO 1
<211> LENGTH: 237
<212> TYPE: PRT
<213> ORGANISM: Bacillus agaradhaerens

<400> SEQUENCE: 1

Met Leu Thr Leu Leu Met Met Ser Phe Ala Gly Ala Ala Tyr Ala His
1               5                   10                  15

Asn Pro Val Thr Asp Glu Glu Val Tyr His Ser Phe Asn Ser His Asp
            20                  25                  30

Trp Gln Asn Trp Asn Met Ser Asp Gly Trp Lys Asn Asp Asp Tyr Phe
        35                  40                  45

Phe Gly Cys His Trp Ser Gln Asn Arg Val Asn Phe Tyr Gly Gly Gln
    50                  55                  60

Met Glu Leu Ser Leu Arg Thr Asn Tyr Ser Tyr Ala Pro Pro Tyr Asn
65                  70                  75                  80

Tyr Glu Cys Ala Glu Tyr Thr Thr Asn Asn Phe Tyr Gly Tyr Gly Leu
                85                  90                  95

Tyr Glu Val Ser Met Lys Pro Ala Lys Val Ser Gly Val Ile Ser Ser
            100                 105                 110

Phe Phe Thr Tyr Thr Gly Pro Ser Tyr Asn Gly Ala Pro Trp Asp Glu
        115                 120                 125

Ile Asp Ile Glu Phe Leu Gly Asn Asp Thr Thr Lys Val Gln Phe Asn
    130                 135                 140

Tyr Tyr Thr Asp Gly Val Gly Gly Asn Glu Ile Leu Tyr Asp Leu Gly
145                 150                 155                 160

Phe Asp Ala Ala Asp Ser Tyr Asn Thr Tyr Ala Phe Asp Trp Gln Glu
                165                 170                 175

Asn Tyr Ile Asn Trp Tyr Val Asn Gly Gln Leu Val Ala Thr Ala Thr
            180                 185                 190

Glu Asn Ile Pro Ser Asn Pro Ser Lys Ile Met Met Asn Ile Trp Asn
        195                 200                 205

Thr Tyr Gly Ile Asp Glu Trp Ala Gly Arg Tyr Tyr Gly Glu Asp Ala
    210                 215                 220

Asn Ala Ser Tyr Asn Trp Val Arg Tyr Thr Pro Asn Arg
225                 230                 235


<210> SEQ ID NO 2
<211> LENGTH: 379
```

<212> TYPE: PRT
<213> ORGANISM: Bacillus sp

<400> SEQUENCE: 2

Met Val Lys Ile Lys Ile Asn Asn Ser Ile Arg Ile Val Met Leu Thr
1 5 10 15

Leu Ile Met Met Ser Val Ser Val Val Ala Tyr Ala Tyr Asn Pro Val
20 25 30

Thr Glu Asp Glu Leu Tyr His Ser Phe Asp Ser His Asp Ala Arg Asn
35 40 45

Trp Gln Ile Ser Asp Gly Trp Arg Asn Gly Asp Asp Phe Phe Gly Cys
50 55 60

His Trp Ser Gln Asn Arg Val Asn Phe Asn Arg Gly Glu Met Glu Leu
65 70 75 80

Ser Leu Arg Thr Asn Tyr Ser Tyr Ser Ala Pro Tyr Asn Tyr Glu Cys
85 90 95

Ala Glu Tyr Ala Thr Ser Asn Phe Tyr Gly Tyr Gly Leu Tyr Glu Val
100 105 110

Ser Met Lys Pro Ala Asn Val Ser Gly Val Ile Ser Ser Phe Phe Thr
115 120 125

Tyr Thr Gly Pro Ser Tyr Asn Gly Ala Pro Trp Asp Glu Ile Asp Ile
130 135 140

Glu Phe Leu Gly Asn Asp Thr Thr Lys Val Gln Phe Asn Tyr Tyr Thr
145 150 155 160

Asn Gly Val Gly Gly Asn Glu Ile Ile Tyr Asp Leu Gly Phe Asp Ala
165 170 175

Ala Asn Ser Phe Asn Thr Tyr Ala Phe Asp Trp Gln Glu Asn Tyr Ile
180 185 190

Ser Trp Tyr Val Asn Gly Asn Leu Val Ala Thr Ala Thr Glu Asn Ile
195 200 205

Pro Ser Asn Pro Ser Lys Ile Met Met Asn Val Trp Asn Thr Tyr Gly
210 215 220

Ile Asp Glu Trp Ala Gly Ala Tyr Gly Gly Glu Ala Ala Asn Ala Thr
225 230 235 240

Tyr Glu Trp Val Arg Tyr Thr Pro Asn Asn Gly Asn Thr Thr Pro Ser
245 250 255

Thr Ala Pro Asp Phe Gln Leu Gln Ala Cys Asp Tyr Ser Asp Ser Ser
260 265 270

Gly Ile Thr Ser Trp Ser Cys Gly Val Gly Thr Phe His Ser Ser Asn
275 280 285

Trp Ile Lys Phe Asp Ser Val Asp Leu Ser Thr Gly Tyr Asn Ala Phe
290 295 300

Ala Val Ser Tyr Thr Ser Pro Gly Ser Gly Ser Phe Asp Ile Arg Leu
305 310 315 320

Gly Ser Pro His Gly Gln Arg Ile Gly Thr Val Asn Tyr Gly Ala Thr
325 330 335

Gly Gly Trp Ser Asn Tyr Glu Trp Ser Gly Thr Pro Ser Leu Asp Val
340 345 350

Thr Val Arg Gly Ala His Asp Ile Tyr Ile Val Ala Thr Ser Gly Ala
355 360 365

Ala Asn Leu Arg Glu Phe Trp Phe Lys Asn Glu
370 375

<210> SEQ ID NO 3

<211> LENGTH: 276
<212> TYPE: PRT
<213> ORGANISM: Bacillus akibai

<400> SEQUENCE: 3

Met Lys Lys Lys Phe Val Leu Phe Ser Met Cys Leu Leu Leu Phe Ser
1 5 10 15

Gly Leu Ile Thr Gly Leu Val Gln Ser Pro Gln Val Ala Glu Ala Ala
20 25 30

Glu Arg Pro Ile Gly Thr Thr Phe Val Glu Thr Phe Glu Ser Tyr Asp
35 40 45

Ser Glu Arg Trp Ser Lys Ala Gly Val Trp Thr Asn Gly Gln Met Phe
50 55 60

Asn Ala Thr Trp Tyr Pro Glu Gln Val Thr Phe Ser Asp Gly Lys Met
65 70 75 80

Lys Leu Gln Ile Asp Lys Glu Asp Asn Glu Thr Ala Ser Pro Pro Tyr
85 90 95

Lys Ala Gly Glu Leu Arg Thr Asn Asp Phe Tyr His Tyr Gly Leu Phe
100 105 110

Glu Val Ser Met Lys Pro Ala Lys Ser Thr Gly Thr Val Ser Ser Phe
115 120 125

Phe Thr Tyr Thr Gly Pro Trp Asp Trp Asp Asn Asp Pro Trp Asp Glu
130 135 140

Ile Asp Ile Glu Phe Leu Gly Lys Asp Thr Thr Lys Ile Gln Phe Asn
145 150 155 160

Tyr Phe Thr Asn Gly Val Gly Gly Asn Glu His Tyr His Glu Leu Gly
165 170 175

Phe Asp Ala Ala Asp Asp Phe Asn Thr Tyr Ala Phe Glu Trp Arg Pro
180 185 190

Glu Ser Ile Arg Trp Phe Val Asn Gly Glu Leu Val His Thr Ala Thr
195 200 205

Glu Asn Ile Pro Gln Thr Pro Gln Lys Ile Met Met Asn Leu Trp Pro
210 215 220

Gly Ile Gly Val Asp Gly Trp Thr Gly Arg Phe Asn Gly Glu Asp Thr
225 230 235 240

Pro Val Val Thr Gln Tyr Asp Trp Val Lys Tyr Thr Pro Leu Glu Glu
245 250 255

Leu Gly Cys Tyr Asn Glu Lys Asn Asn Lys Tyr Lys Lys Cys Lys Lys
260 265 270

Thr Lys Val Lys
275

<210> SEQ ID NO 4
<211> LENGTH: 243
<212> TYPE: PRT
<213> ORGANISM: Bacillus mojavensis

<400> SEQUENCE: 4

Met Ser Tyr Arg Met Lys Arg Val Leu Leu Leu Leu Val Thr Gly Leu
1 5 10 15

Phe Met Ser Leu Ser Ala Phe Thr Ser Thr Ala Ser Ala Gln Thr Gly
20 25 30

Gly Ser Phe Phe Asp Pro Phe Asn Gly Tyr Asn Ser Gly Phe Trp Gln
35 40 45

Lys Ala Asn Gly Tyr Ser Asn Gly Asn Met Phe Asn Cys Thr Trp Arg
50 55 60

```
Ala Asn Asn Val Ser Met Thr Ser Leu Gly Glu Met Arg Leu Ala Leu
65                  70                  75                  80

Thr Ser Pro Ser Tyr Asn Lys Phe Asp Cys Gly Glu Asn Arg Ser Val
                85                  90                  95

Gln Thr Tyr Gly Tyr Gly Leu Tyr Glu Val Arg Met Lys Pro Ala Lys
            100                 105                 110

Asn Val Gly Ile Val Ser Ser Phe Phe Thr Tyr Thr Gly Pro Thr Asp
        115                 120                 125

Gly Thr Pro Trp Asp Glu Ile Asp Ile Glu Phe Leu Gly Lys Asp Thr
    130                 135                 140

Thr Lys Val Gln Phe Asn Tyr Tyr Thr Asn Gly Val Gly Asn His Glu
145                 150                 155                 160

Lys Leu Val Asp Leu Gly Phe Asp Ala Ala Asn Ala Tyr His Thr Tyr
                165                 170                 175

Ala Phe Asp Trp Gln Pro Asn Ser Ile Lys Trp Tyr Val Asp Gly Gln
            180                 185                 190

Leu Lys His Thr Ala Thr Ser Gln Ile Pro Thr Thr Pro Gly Lys Ile
        195                 200                 205

Met Met Asn Leu Trp Asn Gly Thr Gly Val Asp Glu Trp Leu Gly Ser
    210                 215                 220

Tyr Asn Gly Val Thr Pro Leu Tyr Ala His Tyr Asp Trp Val Arg Tyr
225                 230                 235                 240

Thr Lys Lys


<210> SEQ ID NO 5
<211> LENGTH: 214
<212> TYPE: PRT
<213> ORGANISM: Bacillus amyloliquefaciens

<400> SEQUENCE: 5

Gln Thr Gly Gly Ser Phe Phe Glu Pro Phe Asn Ser Tyr Asn Ser Gly
1               5                   10                  15

Leu Trp Gln Lys Ala Asn Gly Tyr Ser Asn Gly Asp Met Phe Asn Cys
            20                  25                  30

Thr Trp Arg Ala Asn Asn Val Ser Met Thr Ser Ser Gly Glu Met Arg
        35                  40                  45

Leu Ala Leu Thr Ser Pro Ser Tyr Asn Lys Phe Asp Cys Gly Glu Asn
    50                  55                  60

Arg Ser Val Gln Thr Tyr Gly Tyr Gly Leu Tyr Glu Val Arg Met Lys
65                  70                  75                  80

Pro Ala Lys Asn Thr Gly Ile Val Ser Ser Phe Phe Thr Tyr Thr Gly
                85                  90                  95

Pro Thr Asp Gly Thr Pro Trp Asp Glu Ile Asp Ile Glu Phe Leu Gly
            100                 105                 110

Lys Asp Thr Thr Lys Val Gln Phe Asn Tyr Tyr Thr Asn Gly Ala Gly
        115                 120                 125

Asn His Glu Lys Val Ala Asp Leu Gly Phe Asp Ala Thr Asn Ala Tyr
    130                 135                 140

His Thr Tyr Ala Phe Asp Trp Gln Pro Asn Ser Ile Lys Trp Tyr Val
145                 150                 155                 160

Asp Gly Gln Leu Lys His Thr Ala Thr Ser Gln Ile Pro Thr Asn Pro
                165                 170                 175

Gly Lys Ile Met Met Asn Leu Trp Asn Gly Ile Gly Val Asp Asp Trp
            180                 185                 190
```

-continued

```
Leu Gly Ser Tyr Asn Gly Val Asn Pro Leu Tyr Ala His Tyr Asp Trp
        195                 200                 205

Val Arg Tyr Thr Lys Lys
    210


<210> SEQ ID NO 6
<211> LENGTH: 214
<212> TYPE: PRT
<213> ORGANISM: Bacillus subtilis

<400> SEQUENCE: 6

Gln Thr Gly Gly Ser Phe Phe Asp Pro Phe Asn Gly Tyr Asn Ser Gly
1               5                   10                  15

Phe Trp Gln Lys Ala Asp Gly Tyr Ser Asn Gly Asn Met Phe Asn Cys
            20                  25                  30

Thr Trp Arg Ala Asn Asn Val Ser Met Thr Ser Leu Gly Glu Met Arg
        35                  40                  45

Leu Ala Leu Thr Ser Pro Ala Tyr Asn Lys Phe Asp Cys Gly Glu Asn
    50                  55                  60

Arg Ser Val Gln Thr Tyr Gly Tyr Gly Leu Tyr Glu Val Arg Met Lys
65                  70                  75                  80

Pro Ala Lys Asn Thr Gly Ile Val Ser Ser Phe Phe Thr Tyr Thr Gly
                85                  90                  95

Pro Thr Asp Gly Thr Pro Trp Asp Glu Ile Asp Ile Glu Phe Leu Gly
            100                 105                 110

Lys Asp Thr Thr Lys Val Gln Phe Asn Tyr Tyr Thr Asn Gly Ala Gly
        115                 120                 125

Asn His Glu Lys Ile Val Asp Leu Gly Phe Asp Ala Ala Asn Ala Tyr
    130                 135                 140

His Thr Tyr Ala Phe Asp Trp Gln Pro Asn Ser Ile Lys Trp Tyr Val
145                 150                 155                 160

Asp Gly Gln Leu Lys His Thr Ala Thr Asn Gln Ile Pro Thr Thr Pro
                165                 170                 175

Gly Lys Ile Met Met Asn Leu Trp Asn Gly Thr Gly Val Asp Glu Trp
            180                 185                 190

Leu Gly Ser Tyr Asn Gly Val Asn Pro Leu Tyr Ala His Tyr Asp Trp
        195                 200                 205

Val Arg Tyr Thr Lys Lys
    210
```

What is claimed is:

1. A method of washing dishware in a dishwasher, the method comprising:

a) delivering a first composition into a wash liquor, the first composition comprising oxygen bleach and substantially free of enzymes; followed by b) reducing the pH of the wash liquor, wherein the reducing the pH of the wash liquor comprises delivering an intermediate composition to the wash liquor between the delivering the first composition and the delivering the second composition, and wherein the intermediate composition comprises a pH buffering system, wherein the pH buffering system comprises citric acid and optionally, sodium bicarbonate; followed by c) delivering a second composition into the wash liquor, the second composition comprising enzymes;

wherein the first composition has a pH of at least 11 and the pH of the first composition is at least 1 pH unit greater the pH of the second composition, and wherein the pH is measured at wash concentration at 20° C.

2. The method according to claim 1, wherein the pH of the first composition is at least 1.2 pH units greater the pH of the second composition, and wherein the pH is measured at wash concentration at 20° C.

3. The method according to claim 1, wherein the oxygen bleach of the first composition comprises percarbonate.

4. The method according to claim 1, wherein the first composition further comprises a cleaning agent selected from the group consisting of alkalinity source, complexing agent, builder, polymer, bleach catalyst, bleach activator, surfactant and mixtures thereof.

5. The method according to claim 1, wherein the first composition comprises an alkalinity source, and wherein the alkalinity source comprises sodium hydroxide.

6. The method according to claim 1, wherein the first composition further comprises methyl glycine diacetic acid.

7. The method according to claim 1, wherein the intermediate composition has calcium binding properties.

8. The method according to claim 1, wherein the enzymes comprise amylase and protease.

9. The method according to claim 1, wherein the first composition and the second composition are delivered into a main wash cycle of the dishwasher.

10. The method according to claim 1, wherein the first composition, the second composition, and the intermediate composition are delivered from a dosing system, and wherein the dosing system is located in the dishwasher.

* * * * *